US006149402A

United States Patent [19]

Kim

[11] Patent Number: 6,149,402

[45] Date of Patent: Nov. 21, 2000

[54] SUCTION MUFFLER FOR HERMETIC RECIPROCATING COMPRESSOR

[75] Inventor: Chul Sung Kim, Suwon, Rep. of Korea

[73] Assignee: Samsung Kwang-Ju Electronics, Co., Ltd., Kwangju, Rep. of Korea

[21] Appl. No.: 08/932,336

[22] Filed: Sep. 17, 1997

[30] Foreign Application Priority Data

Sep. 17, 1996 [KR] Rep. of Korea ..... 96-40442 U

[51] Int. Cl.[7] ..... F04B 53/00

[52] U.S. Cl. ..... 417/312; 417/902; 181/403

[58] Field of Search ..... 417/312, 590, 417/902; 181/403

[56] References Cited

U.S. PATENT DOCUMENTS

| | | | |
|---|---|---|---|
| 5,496,156 | 3/1996 | Harper | 417/312 |
| 5,584,674 | 12/1996 | Mo | 417/312 |
| 5,804,777 | 9/1998 | Kim | 181/229 |
| 5,888,055 | 3/1999 | Lee | 417/312 |

*Primary Examiner*—Timonthy S. Thorpe
*Assistant Examiner*—Ehud Gartenberg
*Attorney, Agent, or Firm*—Burns, Doane, Swecker & Mathis, L.L.P.

[57] ABSTRACT

The suction muffler for a hermetic reciprocating compressor having a reciprocating compressing portion, comprises a muffler body formed with a space for containing a refrigerant and having a refrigerant inlet for receiving the refrigerant and a connection portion for transferring the refrigerant to the compressing portion. A wall partitions the refrigerant containing space into a first containing portion which is connected to the refrigerant inlet and a second containing portion which is connected to the connection portion. The partitioning wall is formed with a hole for communicating the first containing portion with the second containing portion. A tubular baffle extends from the connection portion to the inside of the containing space. Accordingly, various paths having various resonance lengths are provided, thereby damping noises having various frequency components effectively.

4 Claims, 3 Drawing Sheets

SUCTION MUFFLER FOR HERMETIC RECIPROCATING COMPRESSOR

BACKGROUND OF THE INVENTION

The present invention relates to a suction muffer for a hermetic reciprocating compressor.

A hermetic compressor is generally employed in a cooling system such as a refrigerator or an air conditioner, so as to compress a gaseous refrigerant from an evaporator and supply the compressed refrigerant to a condenser.

A rotary-type or reciprocating-type compressor is generally used for the hermetic compressor. The reciprocating hermetic compressor includes a suction muffler for a stable supply of a refrigerant to be compressed to a reciprocating compressing portion thereof. The suction muffler temporarily contains the refrigerant which is supplied from outside to be compressed and supplies the refrigerant to the compressing portion through a cylinder head of the reciprocating compressing portion.

FIG. 3 shows a sectional view of a conventional suction muffler for a hermetic reciprocating compressor. As shown in FIG. 3, a suction muffler 40 includes a muffler body 45 forming a containing space 56 for a gaseous refrigerant to be compressed. The suction muffler 40 is provided with a refrigerant inlet 47 which is connected with an external refrigerant supplying pipe 37 and a connection pipe 34 which is connected with a suction port 33 formed in a cylinder head 32 of a compressing portion 31 and serves as a refrigerant outlet. A tubular baffle 51 which extends towards the containing space 56 from the connection pipe 34 is provided inside the muffler body 45. The baffle 51 is supported by a supporting wall 41 which is provided inside the muffler body 45.

The refrigerant is supplied to the refrigerant inlet 47 through the refrigerant supplying pipe 37 and temporarily contained in the containing space 56 of the muffler body 45. Then, the refrigerant flows through the baffle 51 and the connection pipe 34 and is supplied to the compressing portion 31 through the suction port 33 formed in the cylinder head 32 of the compressing portion 31, during a suction stroke of the compressing portion 31.

However, in the hermetic reciprocating compressor, a pulsatory noise with a relatively low frequency due to suction and compression operations and a noise with a relatively high frequency due to opening and closing of suction and discharge valves are generated, during suction and compression strokes. These noises go backwards with respect to the flowing direction of the refrigerant and are transmitted outside through the suction muffler 40 and the inside of a casing of the compressor.

The noises which are transmitted to the suction muffler 40 from the compressing portion 31 are damped by resonance or mutual cancelling while being transmitted and reflected in a variety of directions inside the containing space 56 of the suction muffler 40. The noises which are damped inside the suction muffler 40 forming a resonance box are noise components having frequencies corresponding to values obtained by dividing four times of a resonance length or a resonance depth, along which the noises are reflected, by the velocity of a sound wave.

However, the containing space 56 of the conventional suction muffler 40 provides relatively simple transmission paths of noises, noises having specific frequency ranges are relatively effectively damped, whereas noises having various frequency ranges can not be effectively damped.

SUMMARY OF THE INVENTION

It is an object of the present invention to provide a suction muffler for a hermetic reciprocating compressor which is capable of providing various transmission paths and resonance lengths to effectively damp noises having a variety of frequency components.

To accomplish the above object, there is provided a suction muffler for a hermetic reciprocating compressor having a reciprocating compressing portion, comprising:

a muffler body formed with a space for containing a refrigerant and having a refrigerant inlet for receiving the refrigerant and a connection portion for transferring the refrigerant to the compressing portion;

a wall for partitioning the refrigerant containing space into a first containing portion which is connected to the refrigerant inlet and a second containing portion which is connected to the connection portion, wherein the partitioning wall is formed with a hole for communicating the first containing portion with the second containing portion; and a tubular baffle extending from the connection portion to the inside of the containing space.

Here, it is preferable that the baffle passes through the partitioning wall to connect the connection portion to the first containing portion, the partitioning is arranged such that the section of the first containing portion is of a reverse U-shape and covers the second containing portion and the communication hole is formed such that the center line of the communication hole is parallel with the baffle.

BRIEF DESCRIPTION OF THE DRAWINGS

The above object and advantages of the present invention will become apparent by describing in detail a preferred embodiment thereof with reference to the accompanying drawings in which.

DETAILED DESCRIPTION OF A PREFERRED EMBODIMENT OF THE INVENTION

Figure 1:
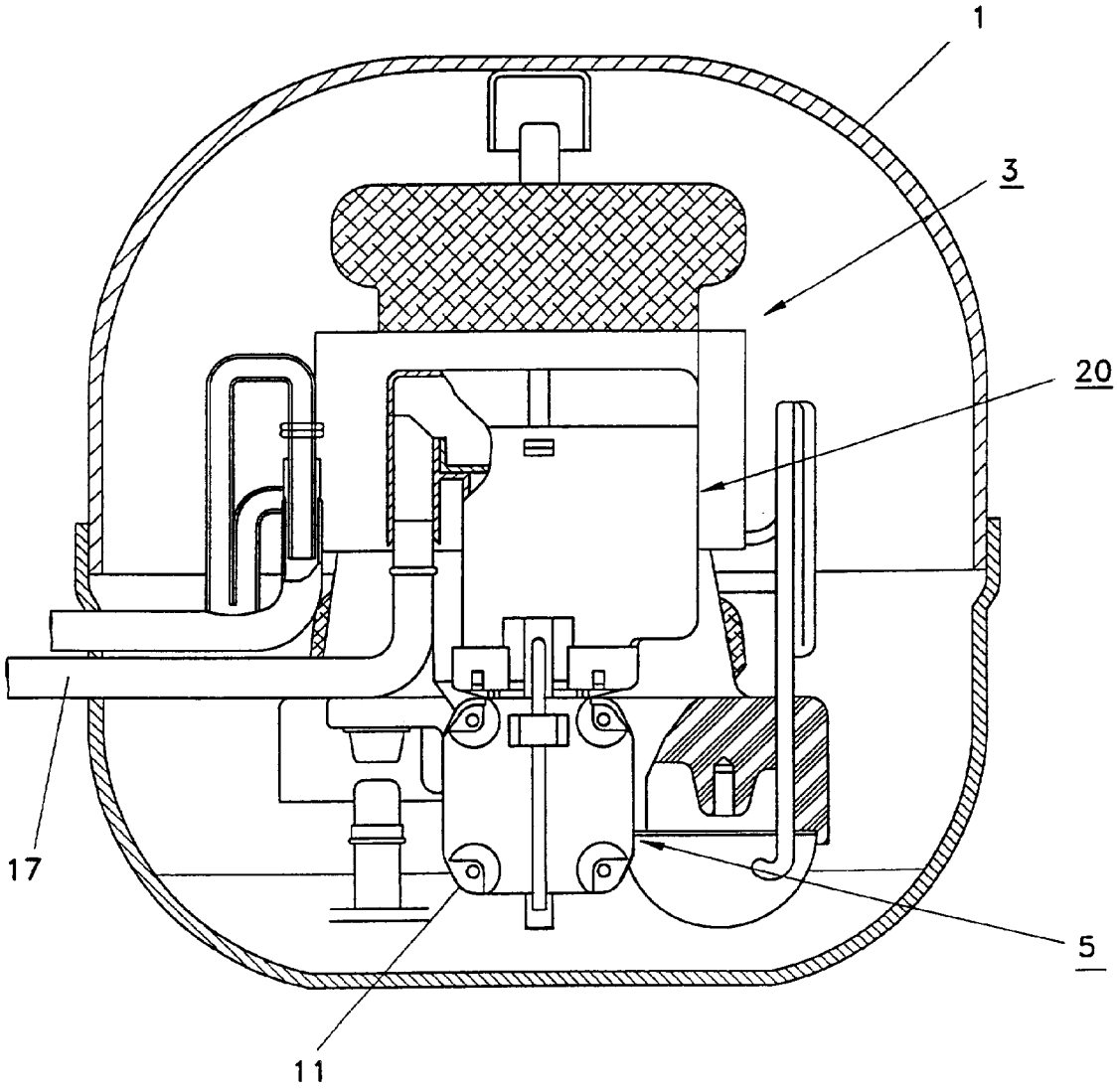
FIG. 1 shows a front section of a hermetic compressor having a suction muffler according to the present invention.

Referring to FIG. 1, a hermetic reciprocating compressor having a suction muffler according to the present invention includes an external casing 1 forming a hermetic space, a driving motor 3 which is installed inside the external casing 1 and a compressing portion 5 which is driven by the driving motor 3 to compress a refrigerant. The compressing portion 5 includes a cylinder (not shown), a piston (not shown) which reciprocates inside the cylinder, a cylinder head 11 and a suction muffler 20 which is coupled with the cylinder head 11 to supply the refrigerant to the compressing portion 5. A refrigerant supplying pipe 17 for supplying the refrigerant from outside to the suction muffler 20 is connected with the suction muffler 20 through the external casing 1.

Figure 2:
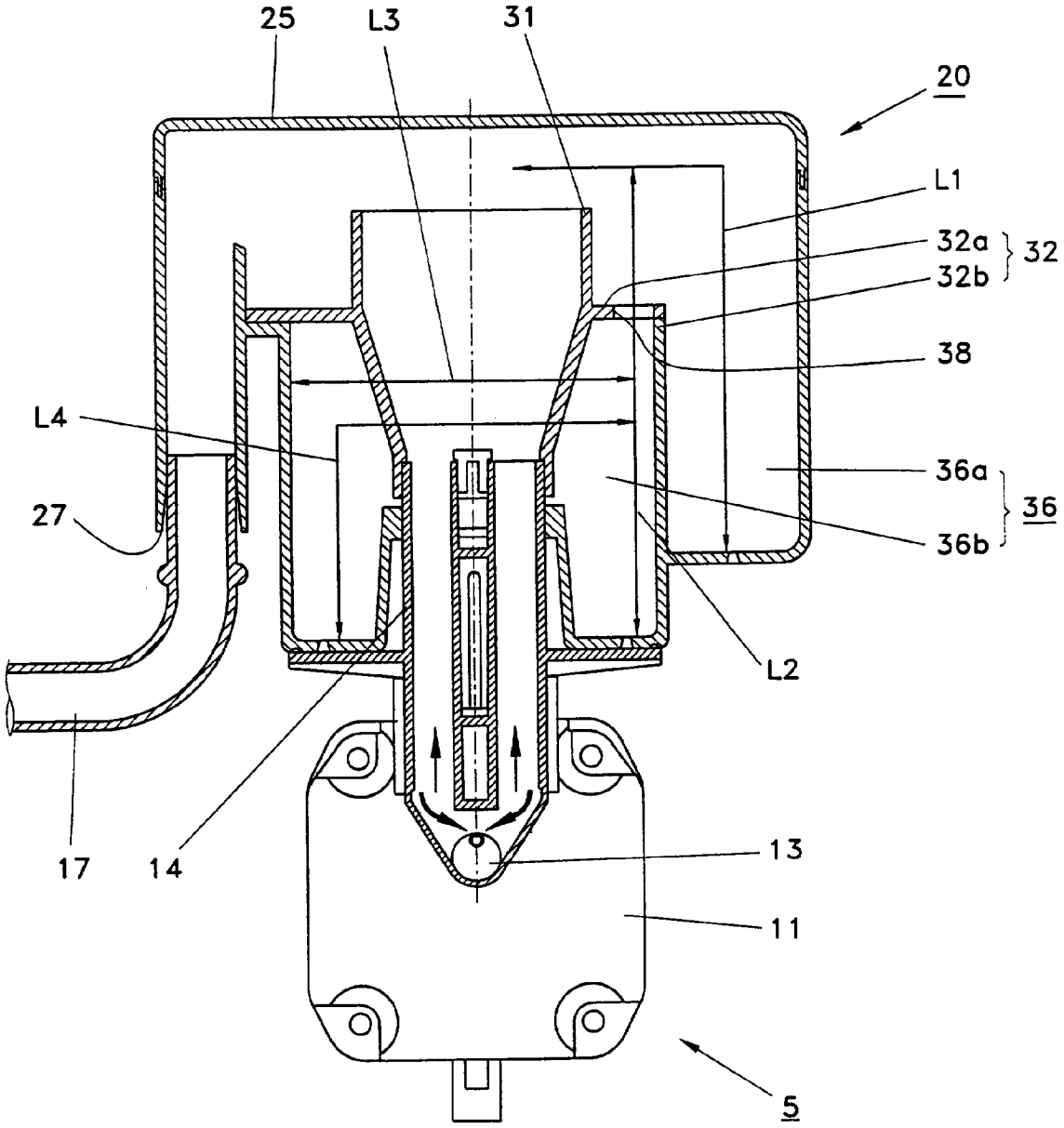
FIG. 2 shows a section of the suction muffler according to the present invention.
Figure 3:
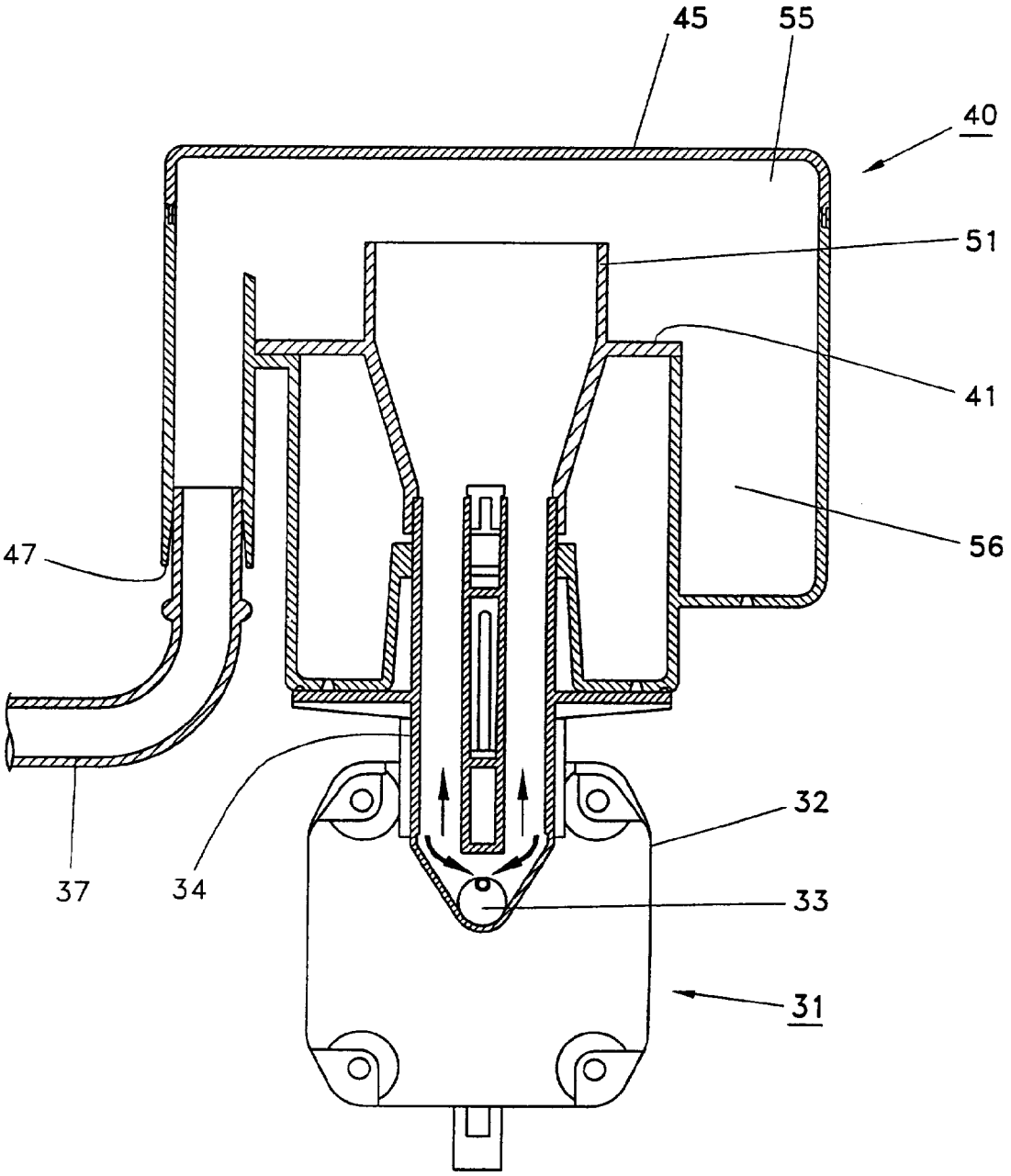
FIG. 3 (PRIOR ART)
FIG. 3 shows a section of a conventional suction muffler for a hermetic compressor.

Referring to FIG. 2, the suction muffler 20 has a muffler body 25 formed with a containing space 36 for temporarily containing the refrigerant. The suction muffler 20 is provided with a refrigerant inlet 27 which is connected with the refrigerant supplying pipe 17 and a connection pipe 14 which is connected with a suction port 13 formed at the cylinder head 11 of the compressing portion 5. The connection pipe 14 is formed with a pair of refrigerant paths which are in parallel and a noise transmission path for transmitting noises generated at the compressing portion 5 to the muffler body 25.

The containing space 36 of the muffler body 25 is divided into first and second containing portions 36*a* and 36*b* which are partitioned by a partitioning wall 32 extending from the inner wall of the muffler body 25. The refrigerant inlet 27 is connected with the first containing portion 36*a* and the connection pipe 14 is connected with the second containing portion 36*b*. The partitioning wall 32 has a first wall 32*a* which is arranged across the connection pipe 14 and a second wall 32*b* which is arranged in parallel with the connection pipe 14, so that the cross section of the first and second walls forms an L-shape. Due to the L-shaped partitioning wall 32, the cross section of the first containing portion 36*a* forms a reverse U-shape. A communication hole 38 is formed in the first wall 32*a* to communicate the first containing portion 36*a* with the second containing portion 36*b*.

The connection pipe 14 extends to the inside of the muffler body 25. A tubular baffle 31 is connected with the upper end portion of the connection pipe 14. The baffle 31 is approximately of a funnel shape and forms a passage which passes through the first wall 32*a*.

The refrigerant is supplied to the containing space 36 through the refrigerant supplying pipe 17 and the refrigerant inlet 27 from an evaporator (not shown). The refrigerant which is contained in the containing space 36 flows through the baffle 31 and the connection pipe 14 and is supplied to the compressing portion 5 through the suction port 13 of the cylinder head 11, during a suction stroke of the compressing portion 5.

Meanwhile, noises generated due to the reciprocation of the piston inside the cylinder and the opening and closing of the valves during the suction and compression strokes of the compressing portion 5 go backwards with respect to the flowing direction of the refrigerant and are transmitted to the containing space 36 of the muffler body 25 through the connection pipe 14 and the baffle 31. The noises reaching the first containing space 36*a* are distributed along various transmission paths and damped by reflections against the inner surface of the muffler body 25, whereas the noises colliding against each other cancel each other. Inside the first containing portion 36*a,* the noises are damped while reciprocating along a first path L1 having an L-shape. Part of the noises are transmitted into the second containing portion 36*b* through the communication hole 38 and damped while reciprocating along a second path L2 inside the second containing portion 36*b*. Part of the noises inside the second containing portion 36*b* branch away from the second path L2 to third and fourth paths L3 and L4 and are damped while reciprocating along the third and fourth paths L3 and L4.

Here, the frequencies of the noises which are damped inside the containing space 36 correspond to values obtained by dividing four times of the lengths of the paths, that is, the resonance lengths by the velocity of the sound wave. According to the above-structured suction muffler, since the paths L1–L4 having various resonance lengths are provided, noises having various frequency components are effectively damped.

As described above, the suction muffler for a hermetic compressor according to the present invention provides various paths having various resonance lengths, to thereby damp noises having various frequency components effectively.

What is claimed is:

1. A suction muffler for a hermetic reciprocating compressor having a reciprocating compressing portion, comprising:

a muffler body formed with a space for containing a refrigerant and having a refrigerant inlet for receiving the refrigerant and a connection portion for transferring the refrigerant to the compressing portion;

a wall for partitioning said refrigerant containing space into a first containing portion which is connected to said refrigerant inlet and a second containing portion which is connected to said connection portion, wherein said partitioning wall is formed with a hole for communicating said first containing portion with said second containing portion; and a tubular baffle extending from said connection portion to the inside of said containing space.

2. A suction muffler for a hermetic reciprocating compressor as claimed in claim 1, wherein said baffle forms a passage which passes through said partitioning wall to connect said connection portion to said first containing portion.

3. A suction muffler for a hermetic reciprocating compressor as claimed in claim 2, wherein said partitioning wall is arranged such that a cross section of said first containing portion is of reverse U-shape and covers said second containing portion.

4. A suction muffler for a hermetic reciprocating compressor as claimed in claim 3, wherein said communication hole is formed such that a center line of said communication hole is parallel with said baffle.

* * * * *